US011125245B2

(12) United States Patent
Watanabe

(10) Patent No.: US 11,125,245 B2
(45) Date of Patent: Sep. 21, 2021

(54) VACUUM PUMP

(71) Applicant: SHIMADZU CORPORATION, Kyoto (JP)

(72) Inventor: Kota Watanabe, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 122 days.

(21) Appl. No.: 16/664,838

(22) Filed: Oct. 26, 2019

(65) Prior Publication Data

US 2020/0208647 A1 Jul. 2, 2020

(30) Foreign Application Priority Data

Dec. 28, 2018 (JP) ..... JP2018-246864

(51) Int. Cl.
*F04D 29/40* (2006.01)

(52) U.S. Cl.
CPC ..... *F04D 29/40* (2013.01)

(58) Field of Classification Search
CPC ..... F04D 19/04; F04D 19/042; F04D 29/522; F04D 29/601; F04D 29/644; F05B 2260/301
See application file for complete search history.

(56) References Cited

U.S. PATENT DOCUMENTS 9,341,188 B2 * 5/2016 Kogame ..... F04D 19/042

FOREIGN PATENT DOCUMENTS

| | | | |
|---|---|---|---|
| CN | 202946804 | A | 5/2013 |
| JP | 2009180147 | A | 8/2009 |
| JP | 2011169165 | A | 9/2011 |
| JP | 4978489 | B9 | 4/2012 |
| JP | 5343884 | B9 | 8/2013 |
| JP | 5626445 | B9 | 10/2014 |

OTHER PUBLICATIONS

English translation of JP2011169165 (Year: 2011).*
Office Action for corresponding CN Application No. 2019108758903 dated Dec. 9, 2020, with English language translation.
Office Action for corresponding CN Application No. 201910875890.3 dated Jul. 2, 2021, with English language translation.

* cited by examiner

*Primary Examiner* — Woody A Lee, Jr.
*Assistant Examiner* — Brian O Peters
(74) *Attorney, Agent, or Firm* — Renner, Otto, Boisselle & Sklar, LLP

(57) ABSTRACT

A vacuum pump housing a rotor, comprises: a first case including a first flange; and a second case including a second flange, connected to the first case through the first flange and the second flange, and arranged on an exhaust port side with respect to the first case. The first flange and the second flange are fastened to each other with a bolt, and the first flange includes a first recessed portion formed corresponding to an attachment position of the bolt at a surface, and the second flange includes a second recessed portion formed corresponding to the attachment position of the bolt at a surface.

9 Claims, 13 Drawing Sheets

VACUUM PUMP

BACKGROUND OF THE INVENTION

1. Technical Field

The present invention relates to a vacuum pump.

2. Background Art

In a vacuum pump housing a rotary body in a case, broken pieces of the rotary body contact other portions upon rotary body damage, and there is a probability that great impact is caused. In a turbo-molecular pump, a rotary body in a case rotates at a high speed of tens of thousands of rpm, and therefore, when broken pieces of the rotary body come into contact with the case, a great torque is provided to the case.

For reducing the torque generated upon rotary body damage, a turbo-molecular pump including a structure for absorbing rotary body energy by deformation of a suction port flange has been proposed (see Patent Literature 1 (Japanese Patent No. 4978489) and Patent Literature 2 (Japanese Patent No. 5343884)).

In the turbo-molecular pump of Patent Literatures 1 and 2, a recessed portion is formed at the suction port flange of the turbo-molecular pump to easily deform a bolt fastening the suction port flange. However, the suction port flange is fastened by screwing of a bolt into a screw hole provided at a flange of a vacuum chamber. A portion of the bolt screwed into the screw hole of the vacuum chamber is less deformable, and absorbs less energy.

SUMMARY OF THE INVENTION

A vacuum pump housing a rotor, comprises: a first case including a first flange; and a second case including a second flange, connected to the first case through the first flange and the second flange, and arranged on an exhaust port side with respect to the first case. The first flange and the second flange are fastened to each other with a bolt, and the first flange includes a first recessed portion formed corresponding to an attachment position of the bolt at a surface, and the second flange includes a second recessed portion formed corresponding to the attachment position of the bolt at a surface.

A bolt hole through which the bolt penetrates is provided at a bottom surface of one of the first recessed portion or the second recessed portion, and a thread portion into which a thread portion of the bolt is screwed is provided at a bottom surface of the other one of the first recessed portion or the second recessed portion.

A center axis of the first recessed portion is shifted from a center axis of the thread portion or the bolt hole provided at the bottom surface of the first recessed portion in a rotation direction of the rotor.

A center axis of the second recessed portion is shifted from a center axis of the bolt hole or the thread portion provided at the bottom surface of the second recessed portion in an opposite direction of a rotation direction of the rotor.

At least one of the first recessed portion or the second recessed portion is a circular recessed portion.

At the bottom surface of one, into which the bolt hole penetrates, of the first recessed portion or the second recessed portion, an elongated hole-shaped slit hole communicating with the bolt hole and extending from the bolt hole in a rotation direction of the rotor or an opposite direction of the rotation direction opens.

At the first recessed portion, a region in the rotor rotation direction with respect to the thread portion or the bolt hole provided at the bottom surface of the first recessed portion is a first region, a region inside the thread portion or the bolt hole in the radial direction is a second region, a region outside the thread portion or the bolt hole in the radial direction is a third region, and a region in an opposite direction of the rotor rotation direction with respect to the thread portion or the bolt hole is a fourth region, and of these regions, the first region is largest, and the fourth region is smallest.

At the second recessed portion, a region in the rotor rotation direction with respect to the bolt hole or the thread portion provided at the bottom surface of the second recessed portion is a first region, a region inside the bolt hole or the thread portion in the radial direction is a second region, a region outside the bolt hole or the thread portion in the radial direction is a third region, and a region in the opposite direction of the rotor rotation direction with respect to the bolt hole or the thread portion is a fourth region, and of these regions, the fourth region is largest, and the first region is smallest.

According to the present invention, the amount of deformation of a bolt fastening two flanges of a vacuum pump upon rotary body damage can be increased, and energy can be absorbed.

DETAILED DESCRIPTION OF THE EXEMPLARY EMBODIMENTS

Hereinafter, embodiments of the present invention will be described with reference to the drawings.

First Embodiment

Figure 1:
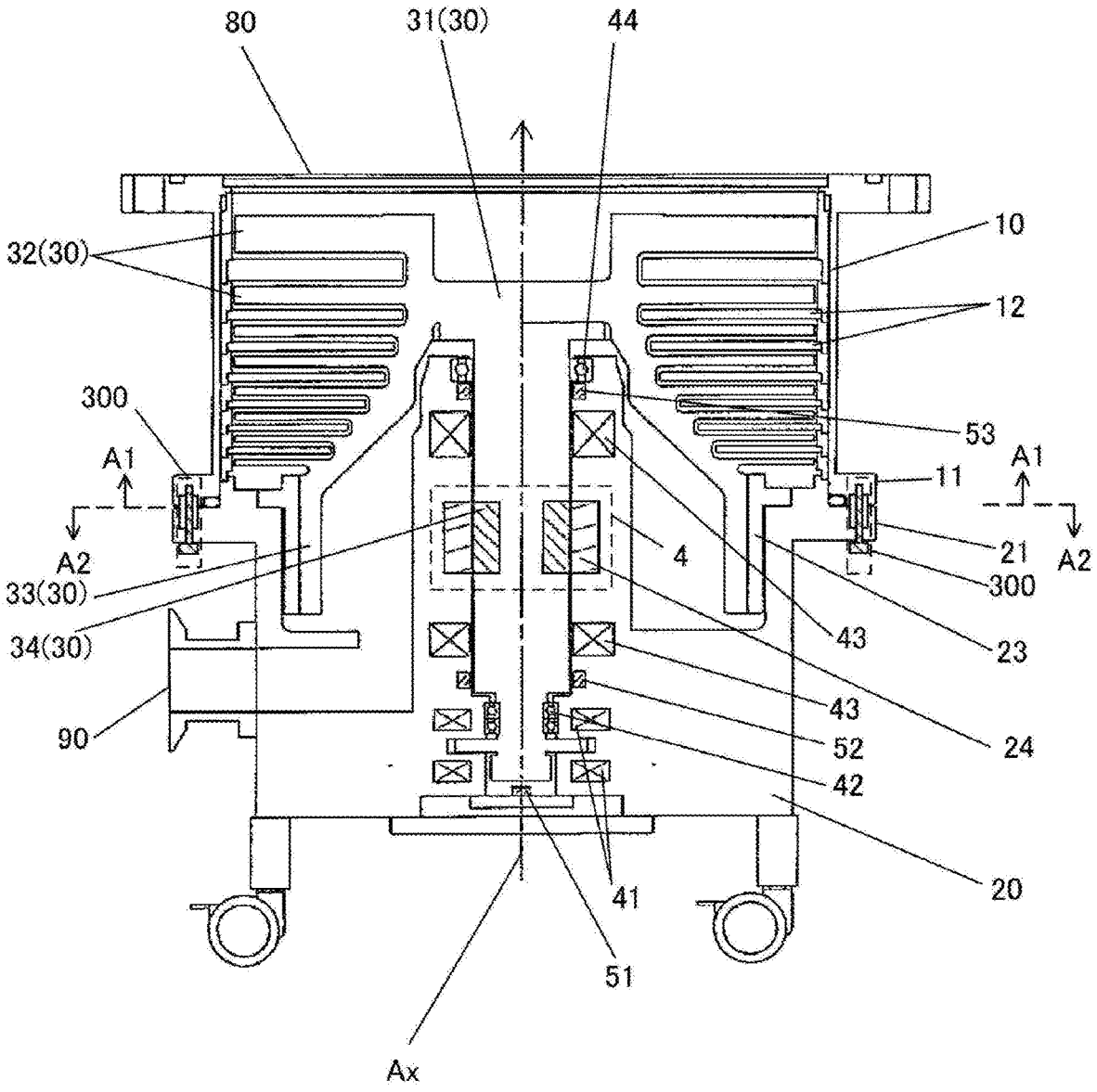
FIG. 1 is a sectional view of a pump main body 1 of a vacuum pump of one embodiment.

FIG. 1 is a sectional view of a pump main body 1 of a vacuum pump of a first embodiment. The vacuum pump of the first embodiment is a turbo-molecular pump, and includes the pump main body 1 illustrated in FIG. 1 and a not-shown controller.

(Description of Turbo-Molecular Pump)

The pump main body 1 includes an outer case 10, a base case 20, a rotor 30 configured to rotate about a rotation axis Ax, and a bolt attachment portion 300 as a fastening portion with a bolt. Hereinafter, terms including an "axial direction," a "radial direction," and a "circumferential direction" each indicate an axial direction, a radial direction, and a circumferential direction of a rotating coordinate system about the rotation axis Ax.

The outer case 10 includes a first flange 11, stationary blades 12, and a suction port 80. The base case 20 includes a second flange 21, a screw stator 23, a motor stator 24, an axial magnetic bearing 41, emergency bearings 42, 44, a radial magnetic bearing 43, an axial displacement sensor 51, radial displacement sensors 52, 53, and an exhaust port 90. The rotor 30 includes a rotor shaft 31, rotor blades 32, a cylindrical portion 33, and a motor rotor 34. The motor stator 24 and the motor rotor 34 form a motor 4.

As illustrated in FIG. 1, multiple stages of the rotor blades 32 are formed at intervals in an upper-to-lower direction at the rotor 30, and the rotor blades 32 and the stationary blades 12 are alternately provided such that each stationary blade 12 is inserted between adjacent ones of the rotor blades 32. The cylindrical portion 33 is formed below the rotor blades 32 of the rotor 30. At the base case 20, the screw stator 23 is provided facing an outer peripheral surface of the cylindrical portion 33, and a spiral groove is formed at an inner peripheral surface of the screw stator 23. The rotor blades 32 and the stationary blades 12 form a turbine blade portion, and the cylindrical portion 33 and the screw stator 23 form a molecular drag pump portion.

The turbo-molecular pump illustrated in FIG. 1 is a magnetic levitation turbo-molecular pump, and the rotor 30 is contactlessly supported by a pair of axial magnetic bearing 41 and radial magnetic bearing 43 on upper and lower sides. The emergency bearings 42, 44 are emergency mechanical bearings. A levitation position of the rotor 30 is detected by the axial displacement sensor 51 and the radial displacement sensor 53.

The rotor 30 rotatably and magnetically levitated by the axial magnetic bearing 41 and the radial magnetic bearing 43 is rotatably driven at high speed by the motor 4. The motor 4 is, for example, a DC brushless motor. The motor rotor 34 including a built-in permanent magnet is attached to the rotor shaft 31, and the motor stator 24 for forming a rotating magnetic field is provided at the base case 20.

Gas molecules flow in through the suction port 80 by high-speed rotation of the rotor 30, and are discharged from the exhaust port 90 through each of gas paths of the turbine blade portion and the molecular drag pump portion. Thus, a suction port 80 side can be brought into a high vacuum state of equal to or lower than 0.1 Pa, for example.

Upon high-speed rotation of the rotor 30, when the rotor 30 is damaged for some reason, e.g., broken pieces of the rotor 30 are scattered circumferentially, and due to the scattered object, a rotation torque in the same direction as a rotation direction of the rotor 30 acts on the outer case 10 or the base case 20. Specifically, in, e.g., a case where the cylindrical portion 33 and the screw stator 23 contact each other, stronger impact might be on the base case 20 arranged on an exhaust port side of the base case 20 than on the outer case 10. In this case, for reducing damage of a vacuum chamber 7 (see FIG. 11) connected to the suction port 80, the first flange 11 and the second flange 21 of the pump main body 1 are formed as described below in the present embodiment.

(First Flange 11)

Figure 2A:
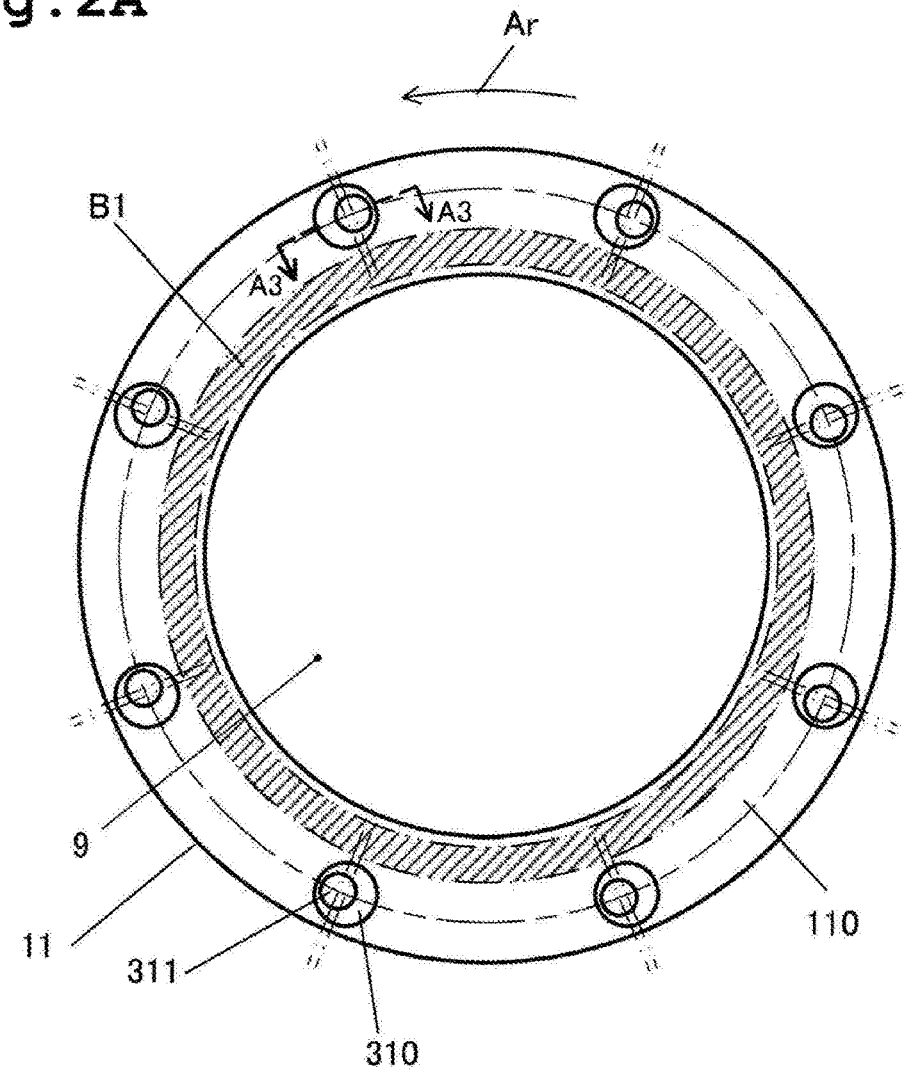
FIG. 2A is a front view of an end surface of a first flange of an outer case.

FIG. 2A is a front view of a fastening-surface-side end surface (hereinafter referred to as a "first end surface 110") of the first flange 11 of the outer case 10. FIG. 2A corresponds to an end view of the first flange 11 of FIG. 1 from the direction of an A1-A1 arrow. The first flange 11 is arranged to surround the rotation axis Ax (FIG. 1). Eight thread portions 311 are formed at the first flange 11. At an inner peripheral surface of each thread portion 311, a not-shown internal thread into which a bolt for fastening the first flange 11 and the second flange 21 is screwed is formed. A circular recessed portion is formed to surround each thread portion 311 at the first end surface 110. Each recessed portion formed at the first end surface 110 will be referred to as a "first recessed portion 310." The first recessed portion 310 is formed corresponding to the thread portion 311 as a bolt attachment position at a surface of the first flange 11, and the thread portion 311 is formed at a bottom portion of the first recessed portion 310.

Note that the number of first recessed portions 310 and thread portions 311 formed at the first end surface 110 is not specifically limited, and may be set as necessary, such as a dozen. Moreover, the thread portion 311 may penetrate the first recessed portion 310.

A hatched region, i.e., a flange surface region on an inner peripheral side with respect to the first recessed portions 310, is a seal region B1. An O-ring groove for arranging an O-ring is formed in the seal region B1. The rotor 30 and the like are housed in an inner space 9 of the first flange 11, but are not shown in the figure. The rotation direction (hereinafter referred to as a "rotor rotation direction") of the rotor 30 is indicated by an arrow Ar. In each figure below, the arrow Ar indicates the rotation direction of the rotor 30. The rotation direction of the embodiment is a clockwise rotation direction about the rotation axis Ax.

Figure 2B:
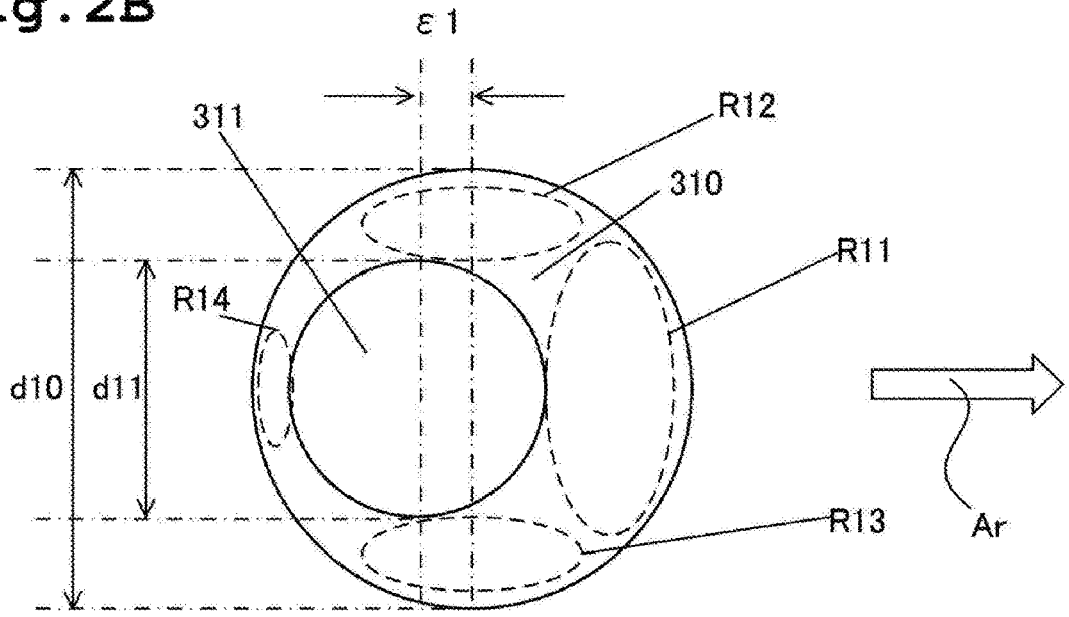
FIG. 2B is an enlarged front view of a first recessed portion.

FIG. 2B is an enlarged front view of the first recessed portion 310. The diameter dimension d10 of the first recessed portion 310 is greater than the diameter dimension d11 of the thread portion 311, and is set to such a size that the thread portion 311 is arranged inside the first recessed portion 310. Moreover, the center position of the first recessed portion 310 is eccentric with respect to the center position of the thread portion 311 in the rotor rotation direction by ε1. For example, 5% to 30% of d10 can be set as ε1, as necessary.

At the first recessed portion 310, a region in the rotor rotation direction with respect to the thread portion 311 is a first region R11, a region inside the thread portion 311 in the radial direction is a second region R12, a region outside the thread portion 311 in the radial direction is a third region R13, and a region in an opposite direction of the rotor rotation direction with respect to the thread portion 311 is a fourth region R14.

Of these regions, the first region R11 is largest, and the fourth region R14 is smallest. Upon damage of the rotor 30, the amount of displacement of the bolt in the rotor rotation direction with respect to the thread portion 311 is greatest (see FIG. 6), the amount of displacement in the radial direction is second greatest, and the probability of displacing in the opposite direction of the rotor rotation direction is low. Thus, each region is set as described above, and therefore, it is configured such that upon damage of the rotor 30, the bolt is easily displaceable and easily absorbs energy.

(Second Flange 21)

Figure 3A:
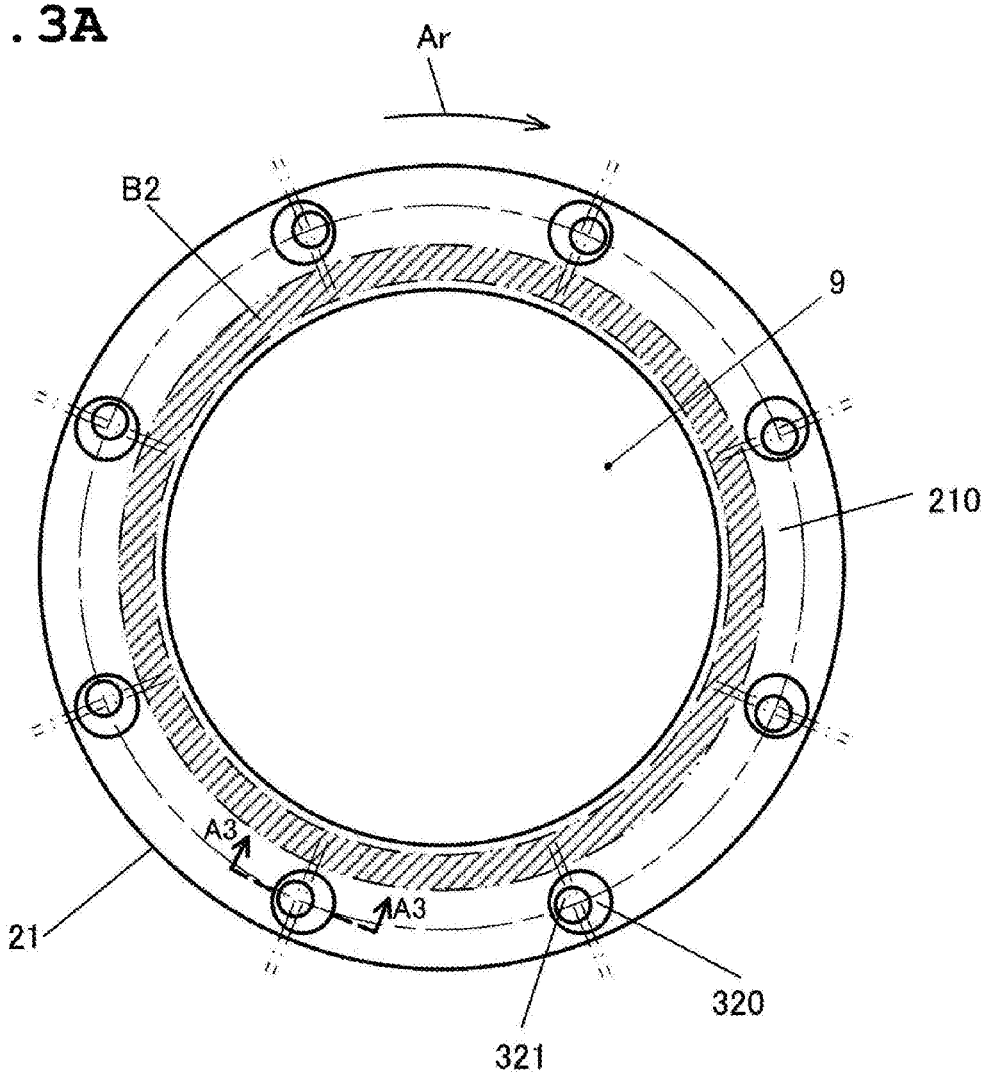
FIG. 3A is a front view of an end surface of a second flange of a base case.

FIG. 3A is a front view of a fastening-surface-side end surface (hereinafter referred to as a "second end surface 210") of the second flange 21 of the base case 20. FIG. 3A corresponds to an end view of the second flange 21 of FIG. 1 from an A2-A2 direction. The second flange 21 is arranged to surround the rotation axis Ax (FIG. 1). In the second flange 21, eight bolt holes 321 are formed corresponding to the thread portions 311 of the first flange 11. At the second end surface 210, a circular recessed portion is formed to surround each bolt hole 321. Each recessed portion formed at the second end surface 210 will be referred to as a "second recessed portion 320." The second recessed portion 320 is formed corresponding to the bolt hole 321 as a bolt attachment position at a surface of the second flange 21, and the bolt hole 321 is formed to penetrate a bottom portion of the second recessed portion 320.

Note that the number of second recessed portions 320 and bolt holes 321 formed at the second end surface 210 is not specifically limited, and may be set as necessary, such as a dozen.

A hatched region, i.e., a flange surface region on the inner peripheral side with respect to the second recessed portions 320, is a seal region B2. The seal region B2 defines a flat seal surface pressing the O-ring.

Note that an O-ring groove may be provided in the seal region B2. In this case, the seal region B1 (FIG. 2A) defines a flat seal surface.

Figure 3B:
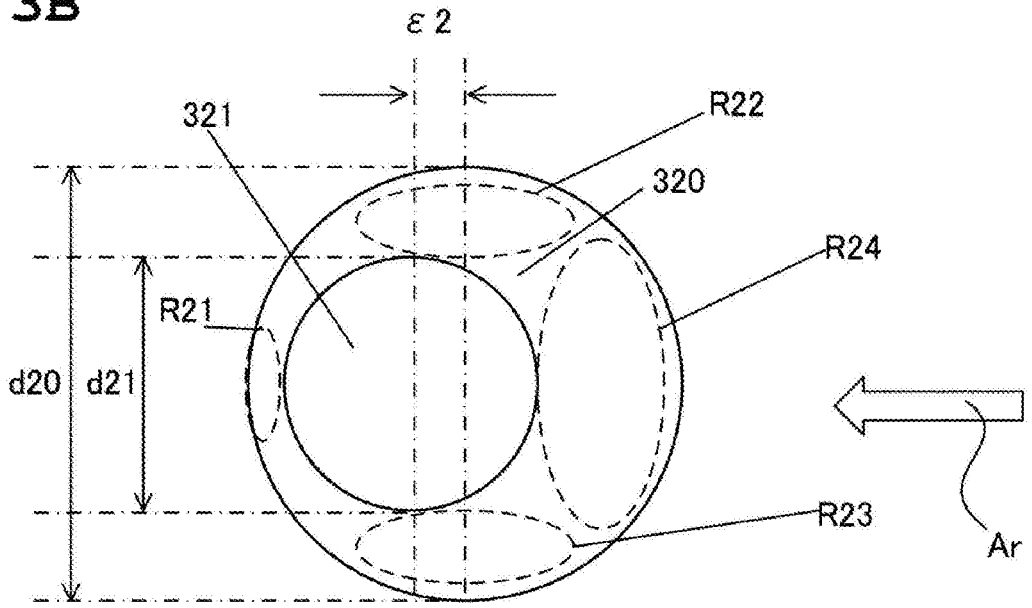
FIG. 3B is an enlarged front view of a second recessed portion.

FIG. 3B is an enlarged front view of the second recessed portion 320. The diameter dimension d20 of the second recessed portion 320 is greater than the diameter dimension d21 of the bolt hole 321, and is set to such a size that the bolt hole 321 is arranged inside the second recessed portion 320. Moreover, the center position of the second recessed portion 320 is eccentric with respect to the center position of the bolt hole 321 in the opposite direction of the rotor rotation direction by ε2. For example, 5% to 30% of d20 can be set as ε2, as necessary.

At the second recessed portion 320, a region in the rotor rotation direction with respect to the bolt hole 321 is a first region R21, a region inside the bolt hole 321 in the radial direction is a second region R22, a region outside the bolt hole 321 in the radial direction is a third region R23, and a region in the opposite direction of the rotor rotation direction with respect to the bolt hole 321 is a fourth region R24.

Of these regions, the fourth region R24 is largest, and the first region R21 is smallest. Upon damage of the rotor 30, the amount of displacement of the bolt in the opposite direction of the rotor rotation direction with respect to the bolt hole 321 is greatest (see FIG. 6), the amount of displacement in the radial direction is second greatest, and the probability of displacing in the rotor rotation direction is low. Thus, each region is set as described above, and therefore, it is configured such that upon damage of the rotor 30, the bolt is easily displaceable and easily absorbs energy.

Figure 4:
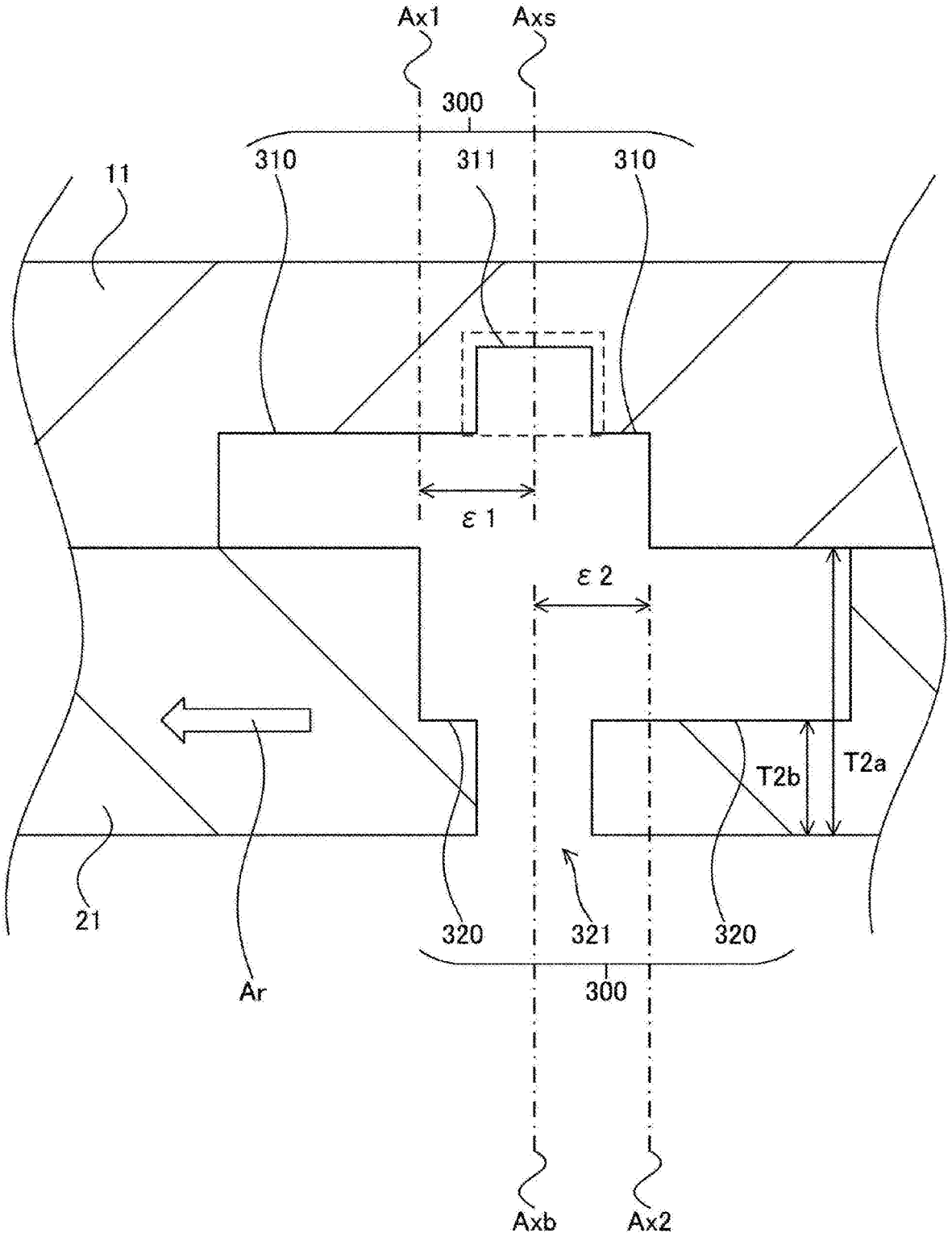
FIG. 4 is a schematic sectional view of a bolt attachment portion.

FIG. 4 is a schematic sectional view of an A3-A3 section of FIGS. 2A and 3A. The center of the thread portion 311 of the first flange 11 and the center of the bolt hole 321 of the second flange 21 are coaxial with each other. These centers may be substantially coaxial with each other. The first recessed portions 310 and the thread portions 311 of the first flange 11 and the second recessed portions 320 and the bolt holes 321 of the second flange 21 form the bolt attachment portion 300.

At the first flange 11, the center axis Ax1 of the first recessed portion 310 is eccentric with respect to the center axis Axs of the thread portion 311 in the rotor rotation direction by ε1. At the second flange 21, the center axis Ax2 of the second recessed portion 320 is eccentric with respect to the center axis Axb of the bolt hole 321 in the opposite direction of the rotor rotation direction by ε2. The thread portion 311 and the bolt hole 321 are arranged substantially coaxially so that the bolt can be screwed into the thread portion 311 through the bolt hole 321.

Although the depth dimension of the second recessed portion 320 is not specifically limited, the depth dimension of the second recessed portion 320 can be, for example, set such that the thickness T2*b* of the periphery of the bolt hole 321 is greater than ½ to ⅓ of the thickness T2*a* of the second flange 21. The depth dimensions of the first recessed portion 310 and the thread portion 311 are not specifically limited. As long as the bolt can fasten the first flange 11 and the second flange 21, the first recessed portion 310 is preferably set as deep as possible, considering an increase in a bolt deformation amount.

At the process of processing a flange end surface, the process of processing (counter boring) the first recessed portion 310 and the process of processing the thread portion 311 are performed in this order for the first flange 11. The process of processing the bolt hole 321 and the process of processing the second recessed portion 320 are performed in this order for the second flange 21.

Figure 5:
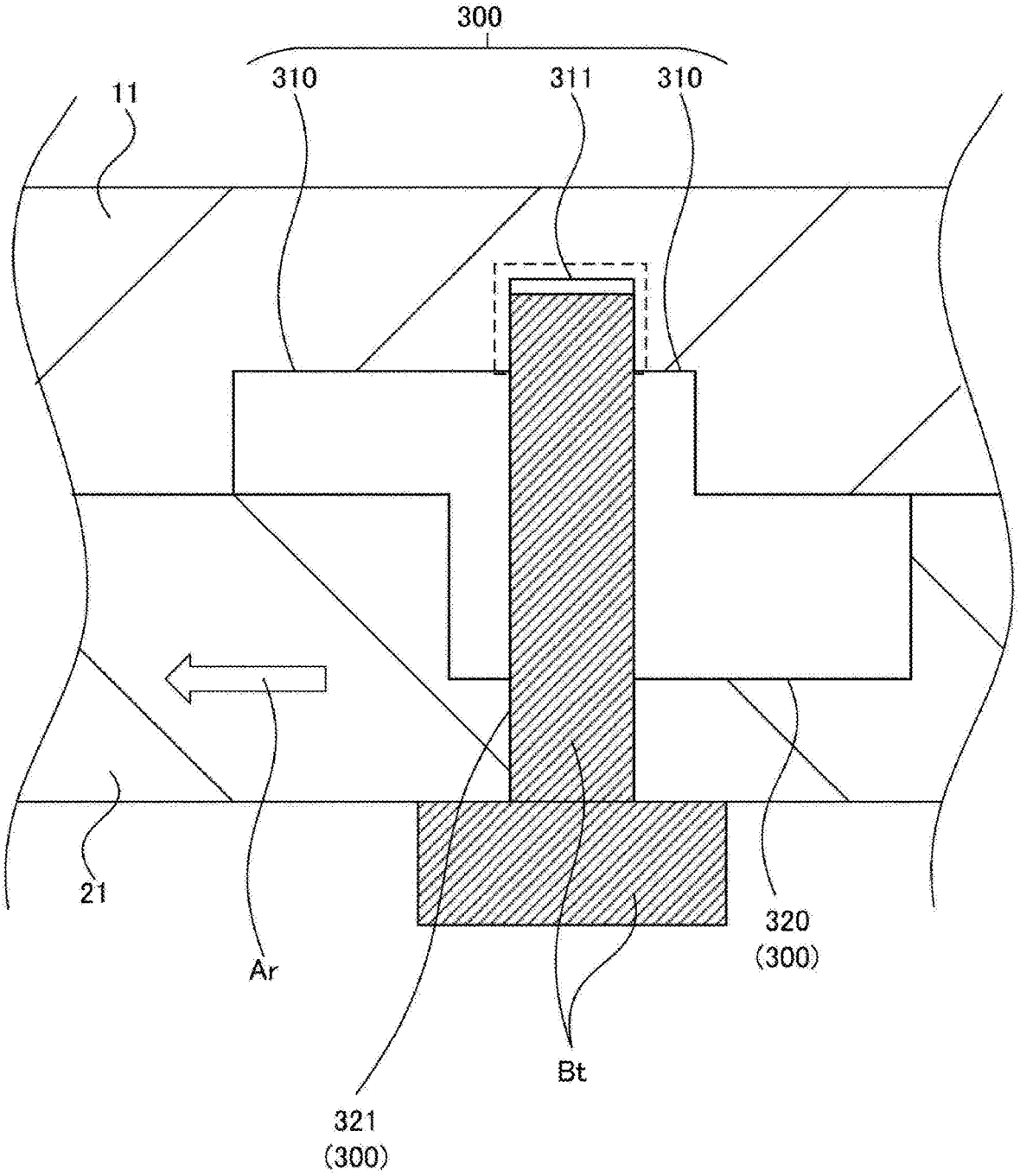
FIG. 5 is a schematic sectional view of the bolt attachment portion to which a bolt is attached.

FIG. 5 is a conceptual diagram of the bolt attachment portion 300 to which a bolt Bt is attached. A head of the bolt Bt inserted from a second flange 21 side contacts an opposite surface of a fastening surface of the second flange 21, and an external thread portion of the bolt Bt is screwed into the not-shown internal thread portion of the inner peripheral surface of the thread portion 311 to fasten the first flange 11 and the second flange 21.

Figure 6:
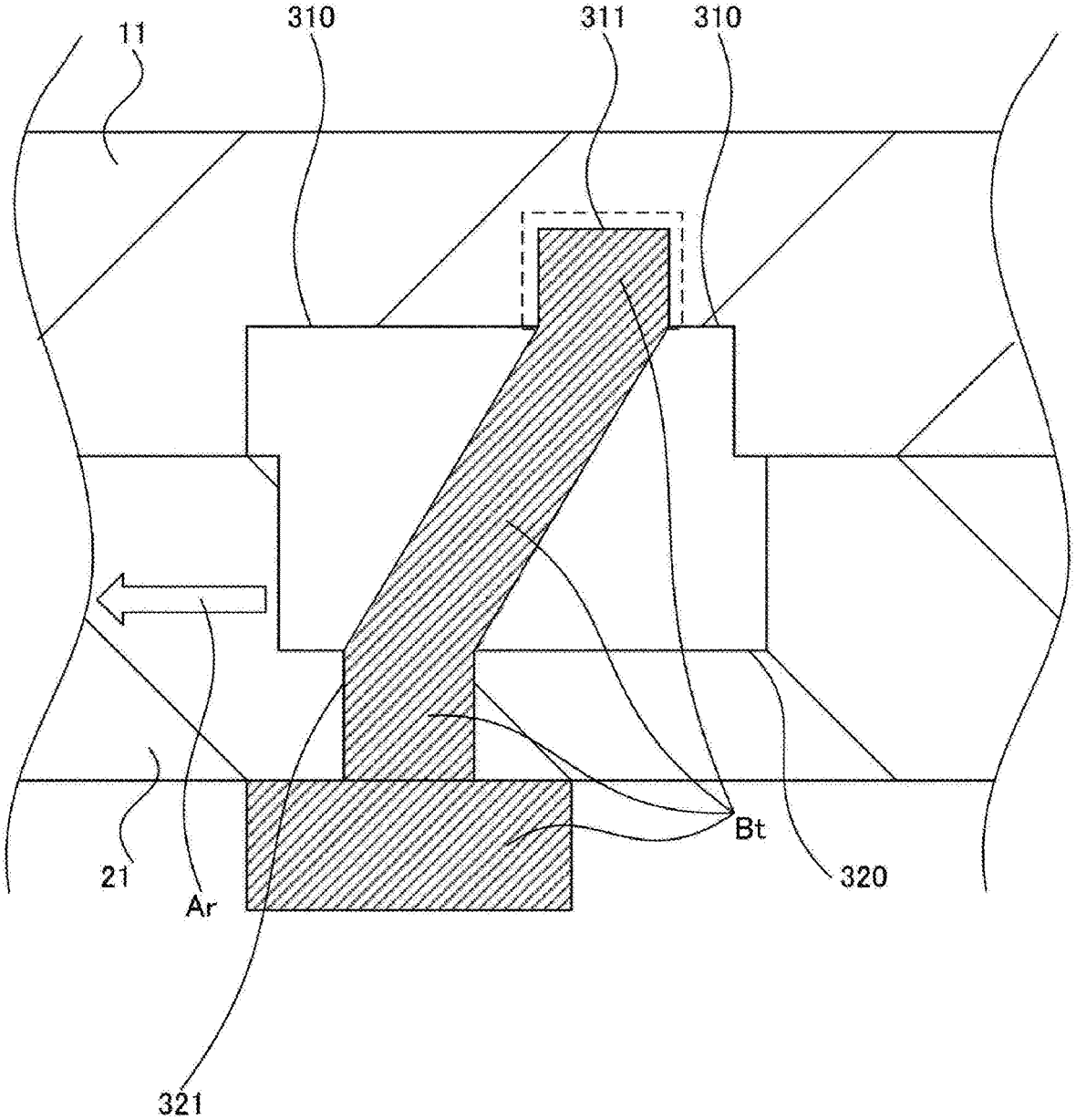
FIG. 6 is a schematic sectional view of deformation of the bolt upon rotor damage.

FIG. 6 is a conceptual diagram of deformation of the bolt Bt in a case where damage of the rotor 30 occurs in a state of FIG. 5 and a stronger torque than that on the outer case 10 is generated on the base case 20 in the rotor rotation direction indicated by the arrow Ar. The second flange 21 moves relative to the first flange 11 along the rotor rotation direction. Thus, a portion of the bolt Bt surrounded by the first recessed portion 310 and the second recessed portion 320 is displaced to a rotor rotation direction side (a first region R11 side of FIG. 2B) relative to the thread portion 311, and is displaced to an opposite side (a fourth region R24 side of FIG. 3B) of the rotor rotation direction relative to the bolt hole 321.

In the present embodiment, the recessed portions are formed on both sides of the flange to expand a bolt deformation space. Thus, a portion where the bolt Bt is deformed upon damage of the rotor 30 is enlarged as compared to a flange configured such that a recessed portion is formed only on one side, and more energy generated due to damage of the rotor 30 can be absorbed.

The following variations are within the scope of the present invention, and combination with the above-described embodiment is allowed. In the following variations, the same reference numerals are used to represent, e.g., structures similar to those of the above-described embodiment and portions having functions similar to those of the above-described embodiment, and description will be omitted as necessary.

(First Variation)

In the above-described embodiment, the first recessed portion 310 and the second recessed portion 320 are in a circular shape, but the shapes of the first recessed portion 310 and the second recessed portion 320 are not specifically limited as long as regions (the first region R11 and the fourth region R24) on a side on which the bolt Bt is displaced relative to the bolt hole 321 upon rotor damage are larger than regions (the fourth region R14 and the first region R21) on the opposite side with respect to the bolt hole 321. For example, in addition to the circular shape, the first recessed portion 310 and the second recessed portion 320 may be, as viewed from above, a so-called elongated hole extending in the circumferential direction, such as an oval shape.

(Second Variation)

In the above-described embodiment, an elongated hole-shaped slit hole may be provided in addition to the bolt hole at the second recessed portion.

Figure 7A:
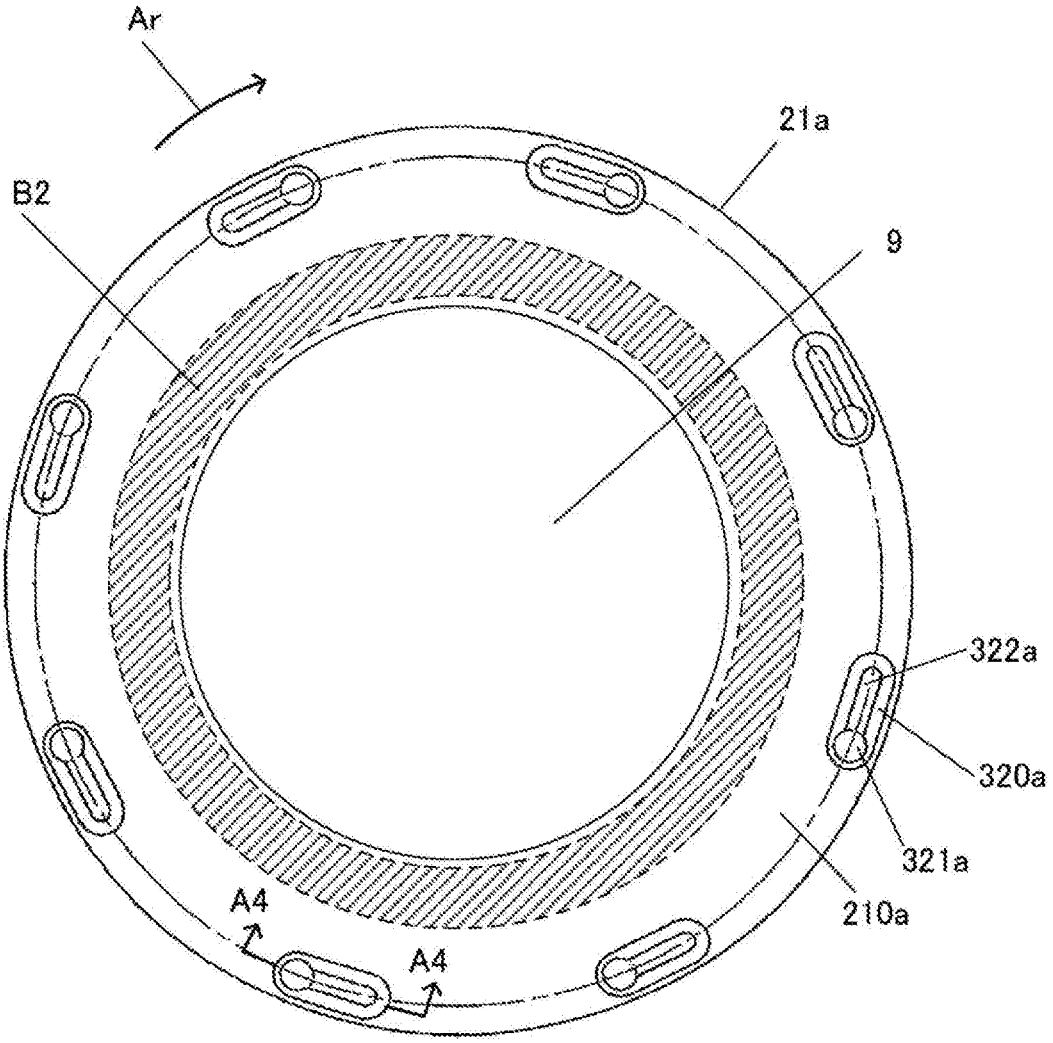
FIG. 7A is a front view of an end surface of a second flange of a base case according to a variation.
Figure 7B:
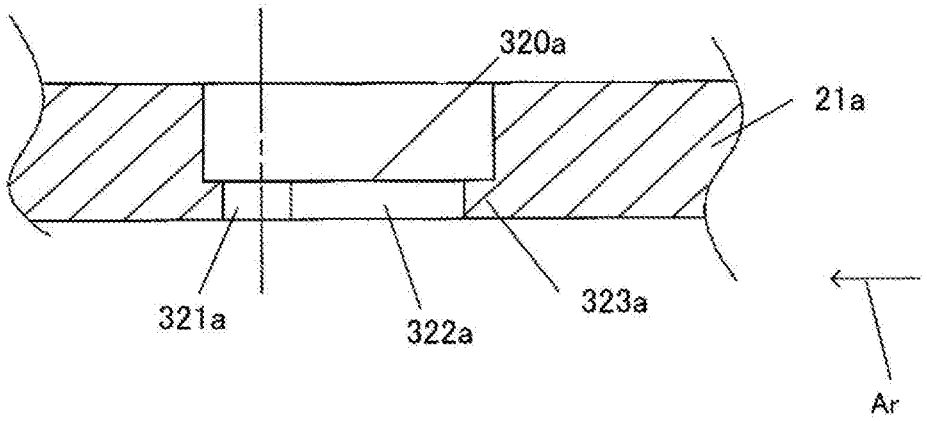
FIG. 7B is a schematic sectional view of a second-flange-side portion of a bolt attachment portion according to the variation.

FIG. 7A is a front view of a second end surface 210*a* of a second flange 21*a* according to the present variation, and FIG. 7B is an A4-A4 sectional view of FIG. 7A. At a fastening-surface-side end surface of the second flange 21*a*, a second recessed portion 320*a* having a predetermined depth is provided corresponding to an attachment position of the bolt Bt. Multiple second recessed portions 320*a* are provided to extend across a predetermined area (e.g., about 5° to 10°) in the circumferential direction, and a thin portion 323*a* having a thin flange thickness is formed below the second recessed portion 320*a*. The thin portion 323*a* is formed with such a thickness that the thin portion 323*a* can be deformed and expanded mainly in the radial direction by relative movement of the bolt Bt as described later, and for easily deforming the thin portion 323*a*, a bolt having a higher hardness than that of the second flange 21*a* is used as the bolt Bt. Note that the bolt Bt and the second flange 21*a* may have the same hardness.

A bolt hole 321*a* having a smaller diameter than the width of the second recessed portion 320*a* is provided to penetrate the center of the second recessed portion 320*a* in a width direction at an end portion on the rotation direction side of the rotor 30. At the center of the second recessed portion 320*a* in the width direction, a slit hole 322*a* opens continuously from the bolt hole 321*a* to an end portion on the opposite side in the rotation direction of the rotor 30. The width of the slit hole 322*a* is smaller than the diameter of the bolt hole 321*a*, and is more smaller than the diameter of the bolt Bt.

Figure 8:
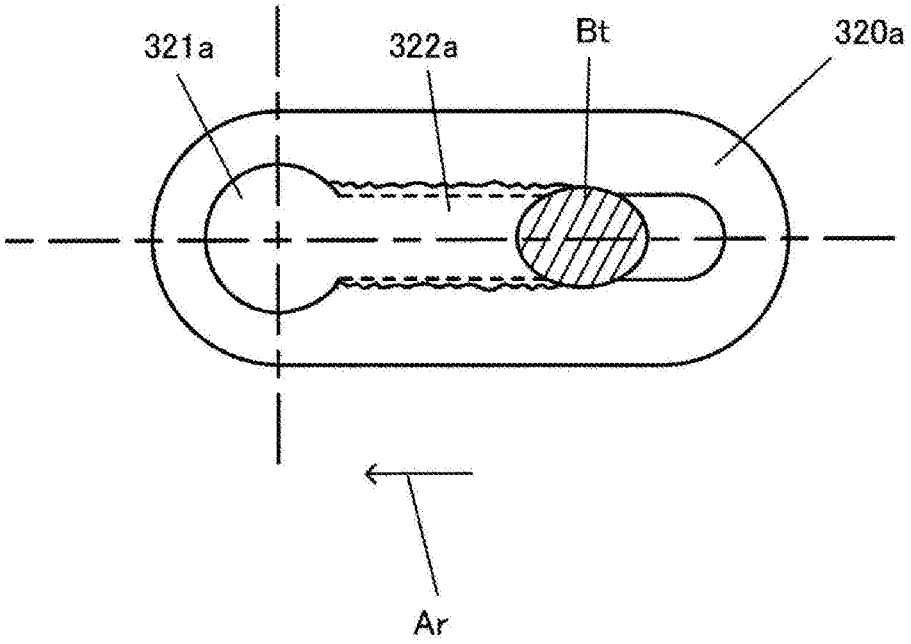
FIG. 8 is a conceptual diagram of deformation of a slit hole upon rotor damage in the variation.

FIG. 8 is a conceptual diagram of movement of the bolt Bt upon rotor damage. Upon damage of the rotor 30, a torque due to, e.g., broken pieces of the rotor 30 acts on the base case 20, and the second flange 21*a* rotates in the rotation direction of the rotor 30. At this point, the bolt Bt is restrained to the first flange 11, and therefore, does not fully follow rotation of the second flange 21. Thus, as illustrated in FIG. 8, the bolt Bt bites into the slit hole 322*a* and pushes and expands the slit hole 322*a*, and accordingly, relatively moves to the opposite side of the rotation direction of the rotor 30 along the slit hole 322*a*. At this point, rotor damage energy is consumed due to friction between the bolt Bt and the slit hole 322*a*. As a result, the amount of torque transmission from the second flange 21*a* to the first flange 11 can be reduced, and damage of the outer case 10 and the vacuum chamber connected to a suction port side of the outer case 10 can be reduced.

(Third Variation)

In the above-described second variation, the width of the slit hole 322*a* is constant in a longitudinal direction, but may be gradually narrowed.

Figure 9:
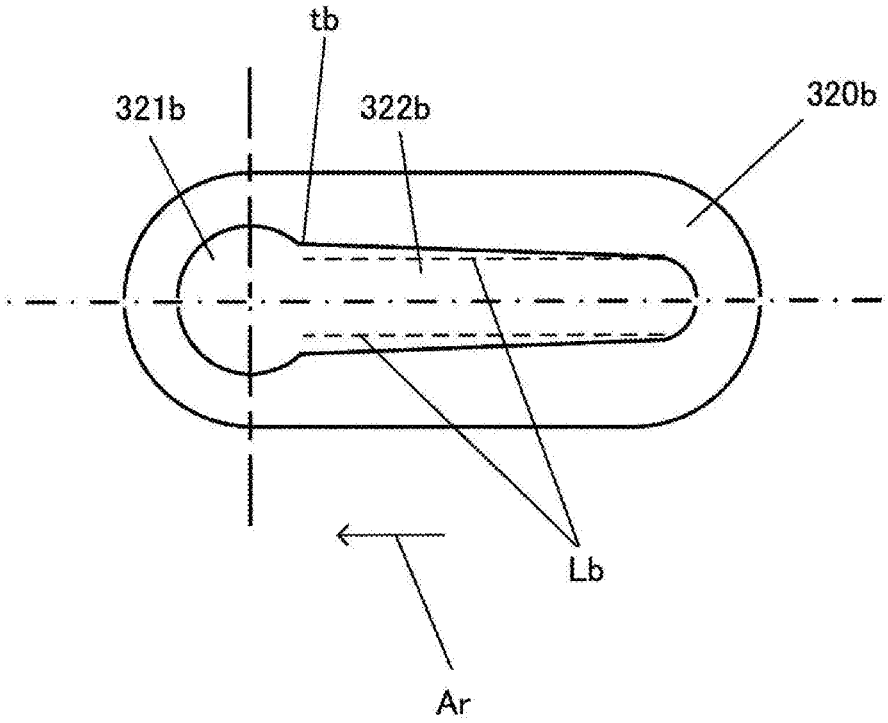
FIG. 9 is a front view of a second recessed portion of a variation.

FIG. 9 is a front view of a second recessed portion 320*b* according to the present variation. A bolt hole 321*b* and a slit hole 322*b* are formed at a bottom surface of the second recessed portion 320*b*. The slit hole 322*b* is formed in a tapered shape along the longitudinal direction. The width of the slit hole 322*b* is maximum at a bolt-hole-side end portion tb, and is gradually narrowed with distance from the bolt hole 321*b*. A dashed line Lb of FIG. 9 corresponds to the width of the slit hole 322*a* of FIG. 7A, and the width of the slit hole 322*b* at the bolt-hole-side end portion tb is wider than that of the slit hole 322*a*. Thus, when a torque acts on the second flange due to damage of the rotor 30, the bolt Bt can be reliably guided to the slit hole 322*b*, and a stable impact absorption effect can be obtained. Note that the slit hole is not necessarily in the tapered shape across the entirety along the longitudinal direction. The slit hole may be formed in the tapered shape halfway in the longitudinal direction, and the remaining portion may have a constant width.

(Fourth Variation)

In the above-described second or third variation, a cover may be provided for the bolt hole. Hereinafter, it will be described that the cover is provided for the bolt hole 321*b* of the third variation. The same reference numerals are used to represent, e.g., structures similar to those of the above-described third variation and portions having functions similar to those of the above-described third variation, and description will be omitted as necessary.

Figure 10A:
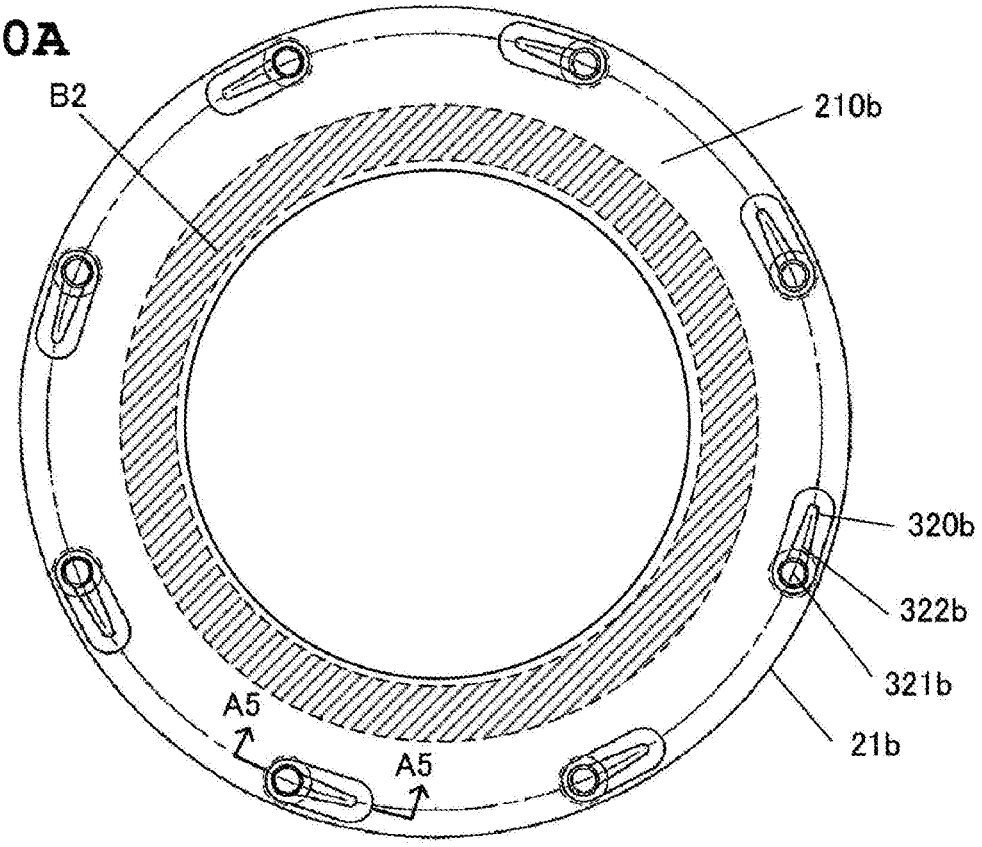
FIG. 10A is a front view of an end surface of a second flange of a base case according to a variation.
Figure 10B:
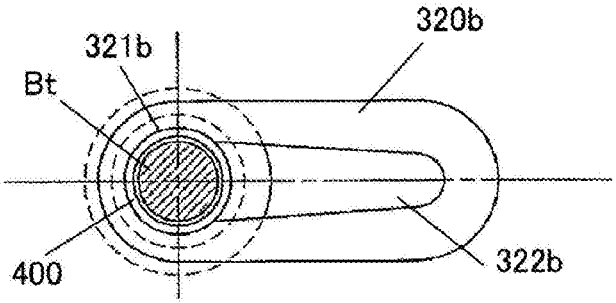
FIG. 10B is an enlarged front view of a second-flange-side portion of a bolt attachment portion to which a bolt is attached.
Figure 10C:
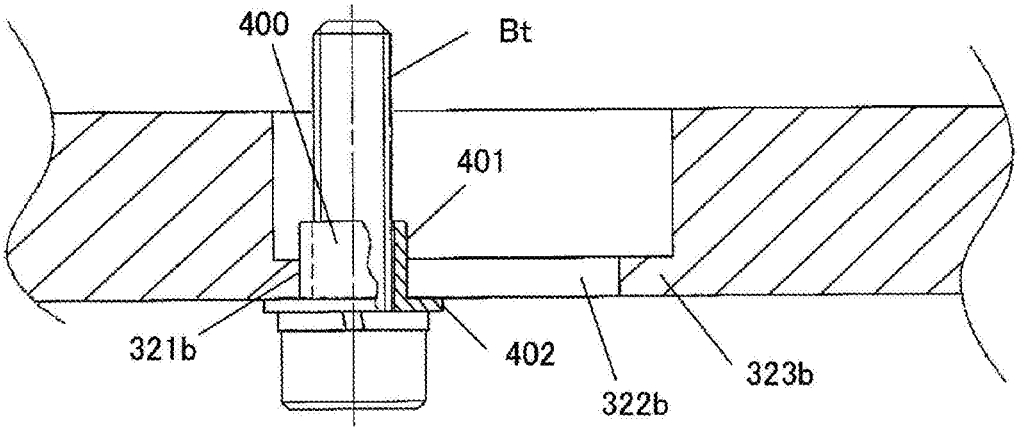
FIG. 10C is a schematic conceptual diagram of the second-flange-side portion of the bolt attachment portion to which the bolt is attached.

FIG. 10A is a front view of a configuration of a second flange 21*b* according to the present variation, FIG. 10B is an enlarged front view of the second recessed portion 320*b*, and FIG. 10C is an A5-A5 sectional view of FIG. 10A. The second recessed portion 320*b* is formed at a fastening-surface-side end surface 210*b* of the second flange 21*b*.

A cover 400 has a cylindrical cover cylindrical portion 401 and a ring-shaped washer portion 402 formed on one end side of the cover cylindrical portion 401. The outer diameter of the cover cylindrical portion 401 is substantially equal to the diameter of the bolt hole 321*b*. The cover cylindrical portion 401 is inserted into the bolt hole 321*b* by press-fitting, and the cover 400 is integrally fixed to the second flange 21*b*. The washer portion 402 contacts a flange surface, and the bolt Bt is inserted into the cover cylindrical portion 401.

In the present variation, when a torque acts on the second flange 21*b* due to damage of the rotor 30, the cover 400 relatively moves together with the bolt Bt along the slit hole 322*b*. Thus, the rotor damage energy is consumed by friction between the cover 400 and the slit hole 322*b* and deformation of a cover member. In this case, a surface of the bolt Bt is covered with the cover 400, and the bolt itself does not bite into the slit hole 322*b*. Thus, stress concentration on a screw ridge portion and a screw root portion of a bolt surface can be reduced, and damage of the bolt Bt can be prevented and the stable impact absorption effect can be obtained. Note that the cover 400 is preferably made of a metal different from that of the second flange 21*b* to avoid seizure upon biting into the slit hole 322*b*, and for easily deforming a thin portion 323*b*, is preferably made of a material harder than the second flange 21*b*.

Note that the shape of the cover 400 is not limited to that described above, and such as formation of a slit for facilitating insertion into the bolt hole 321*b*, can be designed as necessary.

(Fifth Variation)

In the above-described second to fourth variations, the depth of the second recessed portion 320*a*, 320*b* may be changed in a stepwise manner along a longitudinal direction of the slit hole 322*a*, 322*b*. Thus, the bolt Bt is easily displaceable along the slit hole 322*a*, 322*b*, and the energy can be more efficiently absorbed.

(Sixth Variation)

In the above-described embodiment, a recessed portion for facilitating deformation of the bolt Bt upon damage of the rotor 30 may be provided at the periphery of a bolt hole of a suction port flange. Thus, the energy upon damage of the rotor 30 can be absorbed at two spots of the recessed portion and the bolt attachment portion 300. Thus, upon rotor damage, damage of the vacuum chamber connected to the suction port flange can be further reduced.

Figure 11:
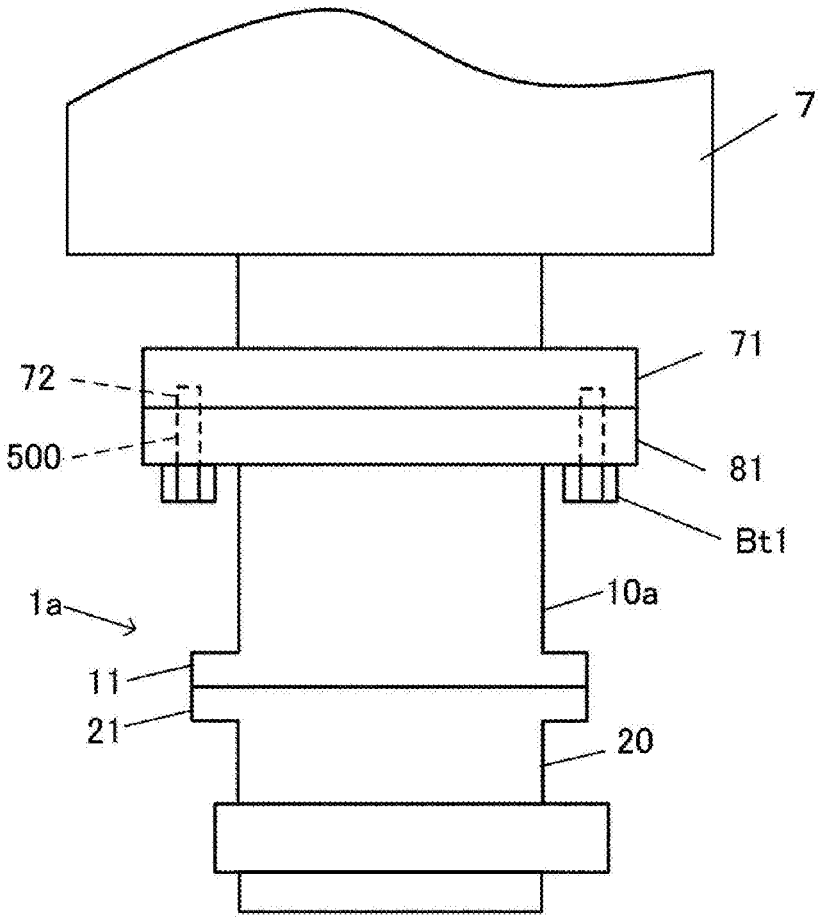
FIG. 11 is a side view of a turbo-molecular pump and a vacuum chamber.

FIG. 11 is a side view of a pump main body 1*a* of a vacuum pump of the present variation. The pump main body 1*a* includes an outer case 10*a* and the base case 20. The outer case 10*a* includes the first flange 11 and a suction port flange 81, and the bolt attachment portion 300 are formed at the first flange 11 and the second flange 21. The vacuum chamber 7 is connected to a suction port side of the outer case 10*a*. The outer case 10*a* and the vacuum chamber 7 are connected to the suction port flange 81 through a device-side flange 71 of the vacuum chamber 7. The suction port flange 81 and the device-side flange 71 are fastened to each other with a bolt Bt1. The bolt Bt1 contacts a surface of the suction port flange 81 opposite to the device-side flange 71, and passes through a suction-port-side bolt attachment portion 500 and is screwed into a device-side thread portion 72 of the device-side flange 71 to fasten both flanges.

Figure 12A:
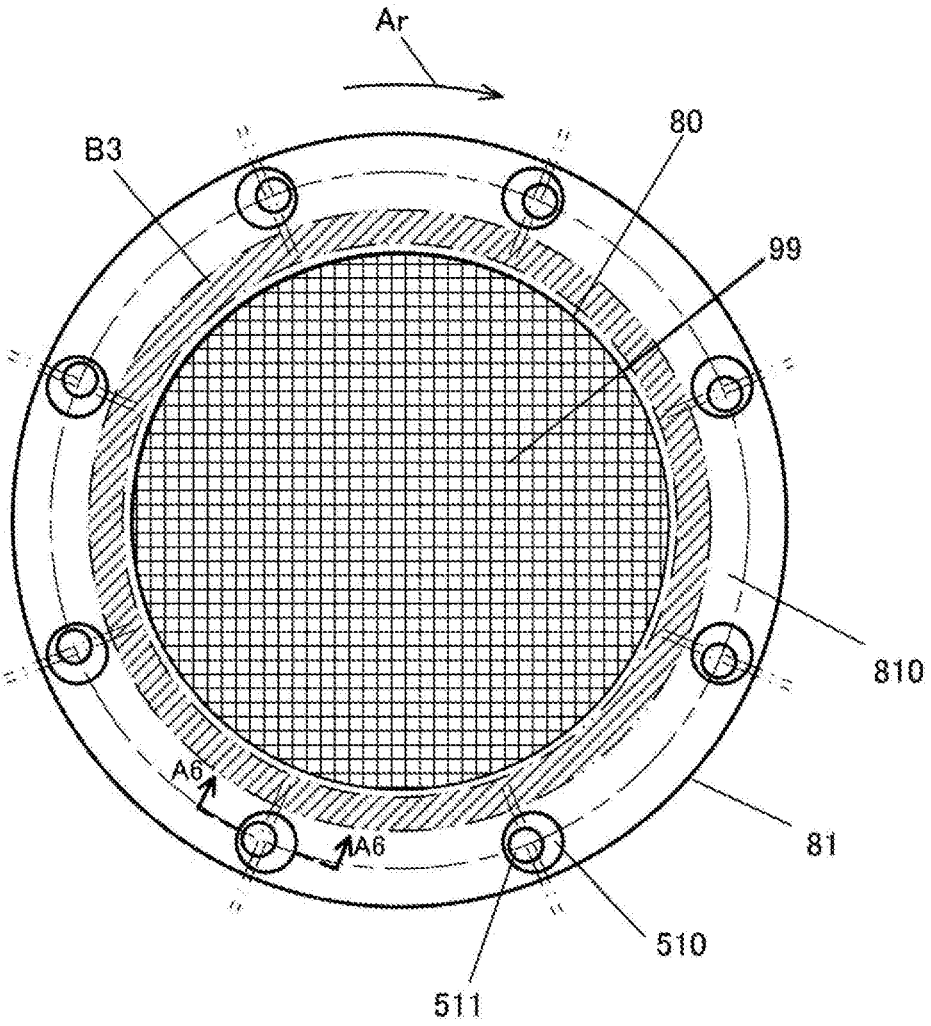
FIG. 12A is a front view of an end surface of a suction port flange of a variation, and FIG. 12B sectional view of a suction-port-side bolt attachment portion according to the variation.
Figure 12B:
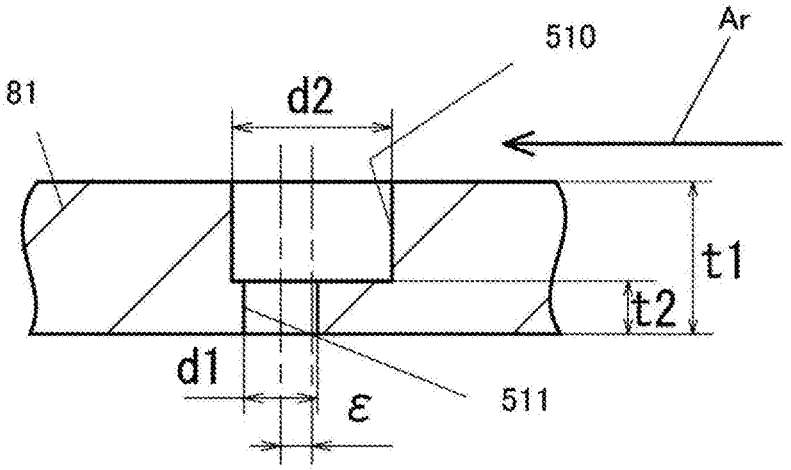

FIG. 12A is a front view of a fastening-surface-side end surface (a third end surface 810) of the suction port flange 81, and FIG. 12B is an A6-A6 sectional view. Eight bolt holes 511 are formed at the suction port flange 81, but the number of bolt holes 511 is not specifically limited. Further, a third recessed portion 510 is formed to surround each bolt hole 511 at the third end surface 810 of the suction port flange 81. The bolt hole 511 is formed to penetrate a bottom portion of the third recessed portion 510.

The diameter dimension d2 of the third recessed portion 510 is greater than the diameter dimension d1 of the bolt hole 511, and is set to such a size that the bolt hole 511 is arranged inside the third recessed portion 510. Moreover, the center position of the third recessed portion 510 is eccentric with respect to the center position of the bolt hole 511 in the opposite direction of the rotor rotation direction by E. The depth dimension of the third recessed portion 510 is preferably set such that the thickness t2 of the periphery of the bolt hole is greater than ½ to ⅓ of the thickness t1 of the suction port flange 81.

Note that the shape of the third recessed portion 510 is not specifically limited, and may be a shape similar to that of the second recessed portion of the above-described embodiment or the above-described variation, for example.

As illustrated in FIG. 12A, a protection net 99 for preventing foreign matter inclusion is provided at the suction port 80 of the suction port flange 81. In a seal region B3, the O-ring groove for arranging the O-ring is formed. Note that in a case where an O-ring seal is provided at the device-side flange 71, the seal region B3 defines a flat seal surface.

(Seventh Variation)

In the above-described embodiment, it may be configured such that the bolt Bt is inserted from a first flange 11 side.

Figure 13:
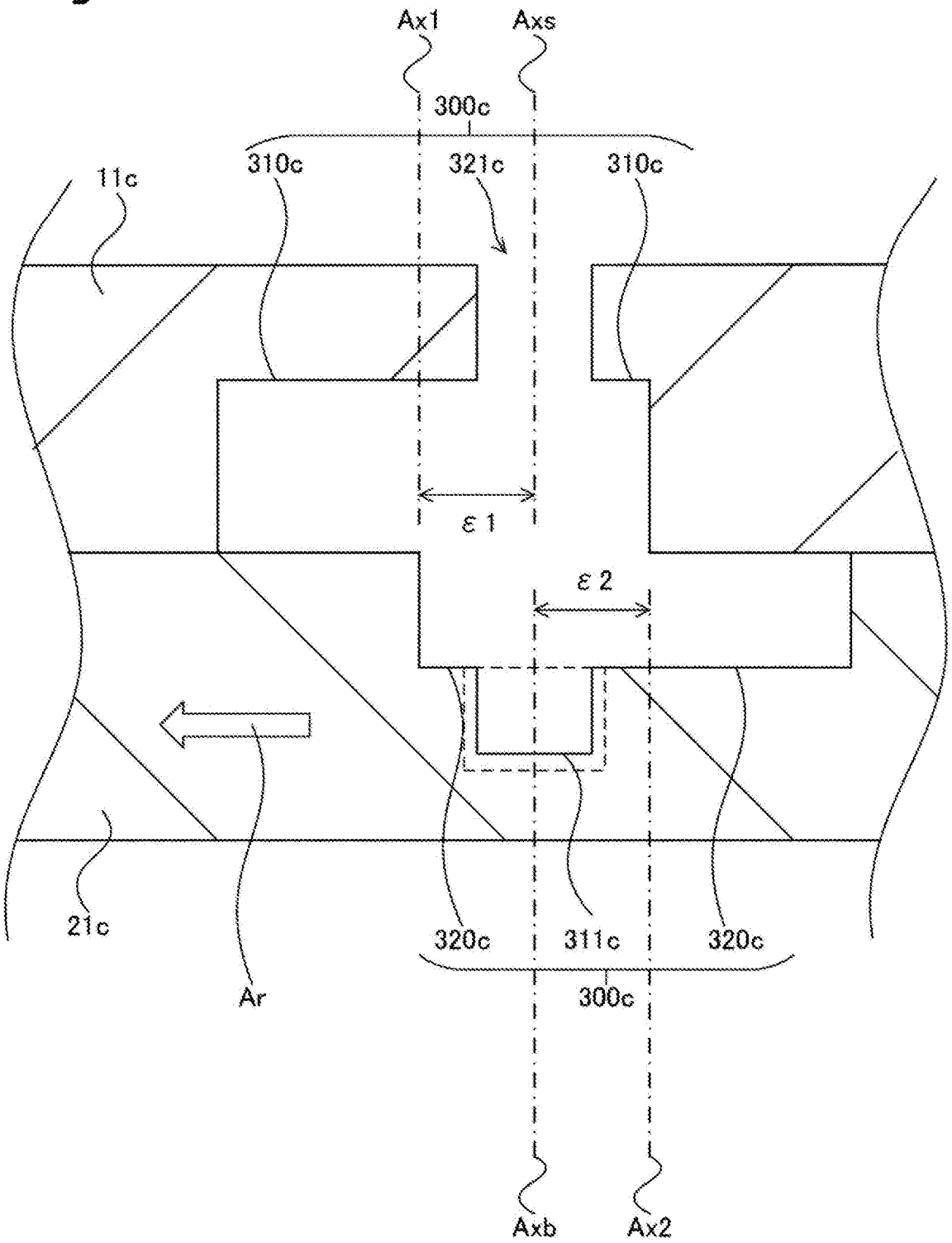
FIG. 13 is a sectional view of a bolt attachment portion of a variation.

FIG. 13 is a schematic sectional view of a bolt attachment portion 300*c* of the present variation. The bolt attachment portion 300*c* includes a first recessed portion 310*c* and a bolt hole 321*c* formed at a first flange 11*c*, and a second recessed portion 320*c* and a thread portion 311*c* formed at a second flange 21*c*. The shapes of the first recessed portion 310*c* and the second recessed portion 320*c* as viewed from the axial direction of the rotation axis Ax may be shapes similar to those of the above-described first recessed portion 310 and the above-described second recessed portion 320 as viewed from the axial direction. The depths of the first recessed portion 310*c* and the second recessed portion 320*c* are adjusted such that the bolt Bt is inserted from a first flange 11*c* side and the first flange 11*c* and the second flange 21*c* are fastened to each other.

Note that in the case of inserting the bolt Bt from the first flange side, the slit hole as in the second to fifth variations may be formed. In this case, the slit hole is, on the first flange 11 side, preferably formed to extend from the bolt hole 321*c* in the rotor rotation direction.

(Eighth Variation)

In the above-described embodiment, the pump main body 1 of the turbo-molecular pump includes the outer case 10 and the base case 20. However, it may be configured such that the pump main body includes three or more cases and the bolt attachment portion is arranged at the flange fastening any pair of two cases connected to each other.

(Ninth Variation)

In the above-described embodiment, the pump main body 1 forms the magnetic levitation turbo-molecular pump, but the configuration of the rotor 30 of the turbo-molecular pump and the type of bearing rotatably supporting the rotor 30 are not specifically limited. For example, the present invention is also applicable to a turbo-molecular pump including no molecular drag pump. For example, in a turbo-molecular pump configured such that a rotor 30 is supported by a rolling bearing on a low vacuum side, strong impact might be on an exhaust-port-side case due to galling of the rolling bearing. The present invention is applicable for absorbing energy of such impact.

(Tenth Variation)

In the above-described embodiment, an example where the present invention is applied to the turbo-molecular pump has been described, but as long as a vacuum pump houses a rotor and includes multiple cases, the present invention is applicable to an optional vacuum pump such as a screw groove vacuum pump.

According to the above-described embodiment or variations, the following features and advantageous effects are obtained.

(1) In an embodiment of a first aspect, a vacuum pump is a vacuum pump housing a rotor (30). The vacuum pump includes a first case (10, 10*a*) having a first flange (11, 11*c*), and a second case (20) having a second flange (21, 21*a*, 21*b*, 21*c*), connected to the first case (10, 10*a*) through the first flange (11, 11*c*) and the second flange (21, 21*a*, 21*b*, 21*c*), and arranged on an exhaust port side with respect to the first case (10, 10*a*). The first flange (11, 11*c*) and the second flange (21, 21*a*, 21*b*, 21*c*) are fastened to each other with a bolt (Bt). The first flange (11, 11*c*) includes a first recessed portion (310, 310*c*) formed corresponding to an attachment position of the bolt (Bt) at a surface, and the second flange (21, 21*a*, 21*b*, 21*c*) includes a second recessed portion (320, 320*a*, 320*b*, 320*c*) formed corresponding to the attachment position of the bolt (Bt) at a surface. With this configuration, the amount of deformation of the bolt fastening two flanges of the vacuum pump upon rotary body damage can be increased, and energy can be easily absorbed.

(2) In an embodiment of a second aspect, in the vacuum pump of the first aspect, a bolt hole (321, 321*a*, 321*b*, 321*c*) through which the bolt (Bt) penetrates is provided at a bottom surface of one of the first recessed portion (310, 310*c*) or the second recessed portion (320, 320*a*, 320*b*, 320*c*), and an internal thread portion into which an external thread portion (311, 311*c*) of the bolt (Bt) is screwed is provided at a bottom surface of the other one of the first recessed portion (310, 310*c*) or the second recessed portion (320, 320*a*, 320*b*, 320*c*). With this configuration, the amount of deformation of a bolt portion between the bolt hole and the thread portion can be increased, and the energy can be easily absorbed.

(3) In an embodiment of a third aspect, in the vacuum pump of the second aspect, the center axis (Ax1) of the first recessed portion (310, 310*c*) is shifted from the center axis (Axs) of the internal thread portion (311, 311*c*) in a rotation direction of the rotor. With this configuration, a portion of the bolt Bt within the first recessed portion upon flange fastening can be easily deformed.

(4) In an embodiment of a fourth aspect, in the vacuum pump of the second or third aspect, the center axis (Ax2) of the second recessed portion (320, 320*a*, 320*b*, 320*c*) is shifted from the center axis (Axb) of the bolt hole (321, 321*a*, 321*b*, 321*c*) in an opposite direction of a rotation direction of the rotor (30). With this configuration, a portion of the bolt Bt within the second recessed portion upon flange fastening can be easily deformed.

(5) In an embodiment of a fifth aspect, in the vacuum pump of any one of the first to fourth aspects, at least one of the first recessed portion (310, 310*c*) or the second recessed portion (320, 320*a*, 320*b*, 320*c*) is a circular recessed portion. With this configuration, processing is facilitated.

(6) In an embodiment of a sixth aspect, in the vacuum pump of any one of the second to fourth aspects, at the bottom surface of one, into which the bolt hole (321, 321*a*, 321*b*, 321*c*) penetrates, of the first recessed portion (310, 310*c*) or the second recessed portion (320, 320*a*, 320*b*, 320*c*), an elongated hole-shaped slit hole (322*a*, 322*b*) communicating with the bolt hole (321, 321*a*, 321*b*, 321*c*) and extending from the bolt hole (321, 321*a*, 321*b*, 321*c*) in the rotation direction of the rotor (30) or the opposite direction of the rotation direction opens. With this configuration, upon rotor damage, collision energy can be absorbed by friction force upon movement of the bolt Bt along the slit hole.

The present invention is not limited to the contents of the above-described embodiment. Other aspects conceivable within the scope of the technical idea of the present invention are also included in the scope of the present invention.

What is claimed is:

1. A vacuum pump housing a rotor, comprising:

a first case including a first flange; and a second case including a second flange, connected to the first case through the first flange and the second flange, and arranged on an exhaust port side with respect to the first case, wherein the first flange and the second flange are fastened to each other with a bolt, and the first flange includes a first recessed portion formed corresponding to an attachment position of the bolt at a surface of the first flange, and the second flange includes a second recessed portion formed corresponding to the attachment position of the bolt at a surface of the second flange, the first recessed portion and the second recessed portion each include a corresponding bottom surface, a bolt hole through which the bolt penetrates is provided at the bottom surface of one of the first recessed portion or the second recessed portion, and a thread portion into which a thread portion of the bolt is screwed is provided at the bottom surface of the other one of the first recessed portion or the second recessed portion, and a diameter of the bottom surface of the first recessed portion and a diameter of the bottom surface of the second recessed portion is greater than a diameter of the bolt hole and thread portion provided thereat.

2. The vacuum pump according to claim 1, wherein a center axis of the second recessed portion is shifted from a center axis of the bolt hole or the thread portion provided at the bottom surface of the second recessed portion in an opposite direction of a rotation direction of the rotor.

3. The vacuum pump according to claim 1, wherein at least one of the first recessed portion or the second recessed portion is a circular recessed portion.

4. The vacuum pump according to claim 1, wherein at the bottom surface of one, into which the bolt hole penetrates, of the first recessed portion or the second recessed portion, an elongated hole-shaped slit hole communicating with the bolt hole and extending from the bolt hole in a rotation direction of the rotor or an opposite direction of the rotation direction opens.

5. The vacuum pump according to claim 1, wherein at the second recessed portion, a region in the rotor rotation direction with respect to the bolt hole or the thread portion provided at the bottom surface of the second recessed portion is a first region, a region inside the bolt hole or the thread portion in the radial direction is a second region, a region outside the bolt hole or the thread portion in the radial direction is a third region, and a region in the opposite direction of the rotor rotation direction with respect to the bolt hole or the thread portion is a fourth region, and of these regions, the fourth region is largest, and the first region is smallest.

6. A vacuum pump housing a rotor, comprising:

a first case including a first flange; and a second case including a second flange, connected to the first case through the first flange and the second flange, and arranged on an exhaust port side with respect to the first case, wherein the first flange and the second flange are fastened to each other with a bolt, the first flange includes a first recessed portion formed corresponding to an attachment position of the bolt at a surface of the first flange, and the second flange includes a second recessed portion formed corresponding to the attachment position of the bolt at a surface of the second flange, the first recessed portion and the second recessed portion each include a corresponding bottom surface, a bolt hole through which the bolt penetrates is provided at the bottom surface of one of the first recessed portion or the second recessed portion, and a thread portion into which a thread portion of the bolt is screwed is provided at the bottom surface of the other one of the first recessed portion or the second recessed portion, and wherein a center axis of the first recessed portion is shifted from a center axis of the thread portion or the bolt hole provided at the bottom surface of the first recessed portion in a rotation direction of the rotor.

7. The vacuum pump according to claim 6, wherein a center axis of the second recessed portion is shifted from a center axis of the bolt hole or the thread portion provided at the bottom surface of the second recessed portion in an opposite direction of a rotation direction of the rotor.

8. A vacuum pump housing a rotor, comprising:

a first case including a first flange; and a second case including a second flange, connected to the first case through the first flange and the second flange, and arranged on an exhaust port side with respect to the first case, wherein the first flange and the second flange are fastened to each other with a bolt, the first flange includes a first recessed portion formed corresponding to an attachment position of the bolt at a surface of the first flange, and the second flange includes a second recessed portion formed corresponding to the attachment position of the bolt at a surface of the second flange, the first recessed portion and the second recessed portion each include a corresponding bottom surface, a bolt hole through which the bolt penetrates is provided at the bottom surface of one of the first recessed portion or the second recessed portion, and a thread portion into which a thread portion of the bolt is screwed is provided at the bottom surface of the other one of the first recessed portion or the second recessed portion, and wherein at the first recessed portion, a region in the rotor rotation direction with respect to the thread portion or the bolt hole provided at the bottom surface of the first recessed portion is a first region, a region inside the thread portion or the bolt hole in the radial direction is a second region, a region outside the thread portion or the bolt hole in the radial direction is a third region, and a region in an opposite direction of the rotor rotation direction with respect to the thread portion or the bolt hole is a fourth region, and of these regions, the first region is largest, and the fourth region is smallest.

9. The vacuum pump according to claim 8, wherein at the second recessed portion, a region in the rotor rotation direction with respect to the bolt hole or the thread portion provided at the bottom surface of the second recessed portion is a first region, a region inside the bolt hole or the thread portion in the radial direction is a second region, a region outside the bolt hole or the thread portion in the radial direction is a third region, and a region in the opposite direction of the rotor rotation direction with respect to the bolt hole or the thread portion is a fourth region, and of these regions, the fourth region is largest, and the first region is smallest.

* * * * *